US007937931B2

(12) United States Patent
Pfaeffle et al.

(10) Patent No.: US 7,937,931 B2
(45) Date of Patent: May 10, 2011

(54) PROCEDURE AND CONTROL UNIT TO OPERATE A DIESEL ENGINE

(75) Inventors: Andreas Pfaeffle, Wuestenrot (DE); Wolfgang Klenk, Loechgau (DE); Frank Schweizer, Schwaikheim (DE); Stefan Scherer, Stuttgart (DE); Andreas Schaffrath, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 917 days.

(21) Appl. No.: 11/899,108

(22) Filed: Sep. 4, 2007

(65) Prior Publication Data

US 2008/0053077 A1 Mar. 6, 2008

(30) Foreign Application Priority Data

Sep. 6, 2006 (DE) ..... 10 2006 041 674

(51) Int. Cl.
*F01N 3/00* (2006.01)
*F01N 3/10* (2006.01)
*F02D 41/14* (2006.01)

(52) U.S. Cl. ..... 60/285; 60/274; 60/295; 60/299; 60/301; 123/443

(58) Field of Classification Search ..... 60/273, 60/285, 286, 295, 299, 301, 274; 123/330–334, 123/443, 492; 701/104, 105, 110
See application file for complete search history.

(56) References Cited

U.S. PATENT DOCUMENTS 5,018,494 A * 5/1991 Sonoda et al. ..... 123/339.12
5,622,047 A * 4/1997 Yamashita et al. ..... 60/274
5,771,686 A * 6/1998 Pischinger et al. ..... 60/274

* cited by examiner

*Primary Examiner* — Thomas E Denion
*Assistant Examiner* — Audrey Klasterka
(74) *Attorney, Agent, or Firm* — Merchant & Gould P.C.

(57) ABSTRACT

A procedure is introduced to operate a diesel engine, which has a catalytic converter with three-way conversion characteristics. The procedure is characterized thereby, in that if the engine rotational speed increases without in the process exceeding an engine rotational speed threshold value and the engine's load is greater than a load threshold value, the diesel engine is operated in such a manner that the diesel engine alternately generates an oxidizing and a reductive exhaust gas atmosphere before the catalytic converter. Additionally a control unit is introduced, which controls the sequence of the procedure.

9 Claims, 4 Drawing Sheets

PROCEDURE AND CONTROL UNIT TO OPERATE A DIESEL ENGINE

BRIEF DESCRIPTION OF THE INVENTION

The invention concerns a procedure according to the preamble of claim 1 and a control unit according to the preamble of claim 9. The catalytic converter having three-way conversion characteristics can be an oxidation catalytic converter and/or a $NO_x$ storage catalytic converter.

SUMMARY OF THE INVENTION

The admissible emissions from diesel engines are being increasingly limited by law. Diesel engines deployed in production motor vehicles produce comparatively high $NO_x$ exhaust-gas emissions before the catalytic converter especially at the time when the vehicle is powerfully accelerated in the lower and middle speed ranges of the diesel engine with virtually full throttle, and for this reason the engine is close to the smoke limit. This is particularly problematic with admissible aggregate emissions in mind in driving cycles with a large proportion of such powerful instances of acceleration.

The test for adherence to admissible emission standards occurs under defined operational conditions in selected driving cycles on a roller dynamometer. The FTP75 driving cycle used in the USA has a large proportion of such powerful instances of acceleration. At the same time, American law sets down very demanding $NO_x$ threshold values specifically for this driving cycle. The task resultant from this is to effectively reduce the $NO_x$ emissions specifically in the aforementioned instances of powerful accelerations.

This task is solved by a procedure of the kind mentioned at the beginning of the application by means of the distinguishing characteristics of claim 1 and by a control unit of the kind mentioned at the beginning of the application by means of the distinguishing characteristics of claim 9.

The three-way conversion with on average stoichiometric fuel/air mixture and alternating production of oxidizing and reductive exhaust gas atmospheres before the catalytic converter constitutes the state of the art with regard to gasoline engines. The three-way conversion of pollutants has not as of yet been used for $NO_x$ reduction in diesel engines operating with excess air. This is the case because HC proportions and CO proportions in the exhaust gas of the diesel engine at the catalytic converter react preferably with the residual oxygen from the exhaust gas and less with the nitrogen oxides contained in the exhaust gas.

For this reason, other concepts, which have a $NO_x$ storage catalytic converter or a system for the selective catalytic reduction (SCR) of the nitrogen oxides, are preferred for the $NO_x$ conversion in diesel engines.

The $NO_x$ storage catalytic converter stores during an operation with excess air, i.e. during an oxidized exhaust gas atmosphere, nitrogen oxides, which have been emitted, and converts these stored nitrogen oxides in a reductive exhaust gas atmosphere among other things to molecular nitrogen. The oxidized exhaust gas atmosphere (Lambda greater than 1) can in the process be maintained for time periods in the magnitude of a few minutes before the diesel engine is operated to regenerate the storage catalytic converter for a time period in the magnitude of seconds, in order that it produces the reductive exhaust gas atmosphere (Lambda smaller than 1). A known combustion procedure for the operation of diesel engines with Lambda values less than one makes provision for a switching of the Lambda value during the quasi-steady state operation of the diesel engine. By a quasi-steady state operation of the diesel engine, an operation is thereby understood in which the rotational speed and load of the engine change very little. The procedure is performed in this manner because in the case of a quasi-steady state operation of the engine, the switching of the air mass or the fresh air proportion of a combustion chamber filling from the set point value for the lean operation (Lambda >1, for example Lambda=3) to the set point value in the rich operation (for example Lambda=0.9) can best be executed without a backlash effect on the torque and the drivability of the motor vehicle. This procedural approach, according to which an operation required for the regeneration with Lambda <1 occurs only during quasi-steady state operating conditions, is a disadvantage with regard to driving cycles, in which these conditions are seldom present, because powerful accelerations often occur.

In contrast the diesel engine is operated by means of the invention in such a way during powerful accelerations that it produces alternately an oxidizing and a reductive exhaust gas atmosphere before the catalytic converter. As a result of this, several advantages occur simultaneously:

An initial advantage is that the nitrogen oxides emitted in comparatively large amounts precisely in this operating range of the engine are effectively reduced by way of a three-way conversion. A direct conversion of the relatively high $NO_x$ emissions is thus achieved in this operating range as a result of the three-way catalytic converter function. This advantage is independent of whether the exhaust gas aftertreatment system of the diesel engine has a storage catalytic converter and also occurs, for example, during the use of an oxidation catalytic converter as a component part of the exhaust gas aftertreatment system. If the exhaust gas aftertreatment system has a storage converter, the additional advantage arises of being further able to regenerate the storage catalytic converter entirely or partially.

It is additionally advantageous that the Lambda value for the combustion chamber fillings already drops from Lambda values in the magnitude of 2 to 4 to Lambda values in the magnitude of 1.1 to 1.6. This drop results by means of the closed-loop quality control of the diesel engine, in which the torque is adjusted less by the amount (quantity) of the combustion chamber filling and more by way of the fuel proportion (quality) of the combustion chamber filling. High torque demands, which are present during powerful accelerations, lead accordingly to high fuel proportions and for that reason to the aforementioned Lambda values in the magnitude of 1.1 to 1.6, which already lie comparatively close to the Lambda values, at which a reductive exhaust gas atmosphere occurs.

An additional advantage is that modern diesel engine management systems already adjust the air mass, respectively the fresh air proportion of the combustion chamber fillings, in the operating points characteristic for a powerful acceleration virtually optimally for Lambda values smaller than 1. For that reason, the actual adjustment to Lambda values smaller than 1 occur by way of changes in the injection; that is to say by changes in the quantity and if need be changes in the distribution of the quantity to one or several partial injections and/or to one or several points of injection time. Interventions into the intake air system serving the additional reduction of the air masses are necessary to a lesser extent due to the already low Lambdas; however they are not excluded from consideration.

Significant improvements in the $NO_x$ conversion performance during driving cycles with frequent acceleration phases are as a whole accomplished by the aforementioned advantages. The interventions into the diesel engine management system required to achieve these improvements do indeed change the noise of combustion and the torque generation. These changes are, however, expected when the driver's input demands powerful acceleration and, therefore, shouldn't disturb the driver.

Additional advantages result from the description and the accompanying figures.

It goes without saying that the previously mentioned characteristics and those, which will be subsequently explained, are not only applicable in the combination put forth in each case, but are also applicable in other combinations or individually without departing from the framework of the invention at hand.

BRIEF DESCRIPTION OF THE DRAWINGS

Examples of embodiment of the invention are depicted in the drawings and are explained in detail in the following description. In each case the following are shown in schematic representations.

DETAILED DESCRIPTION OF THE DRAWINGS

Figure 1:
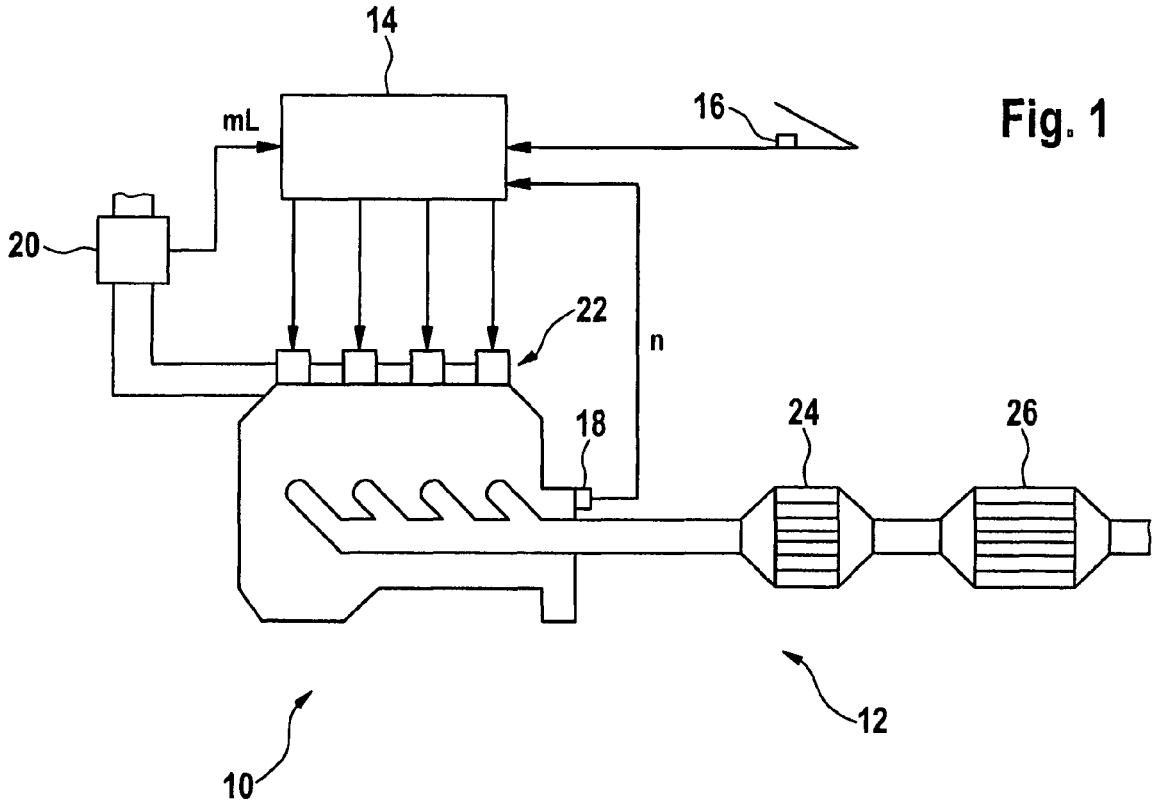
FIG. 1 a diesel engine with an exhaust gas aftertreatment system and a control unit.

FIG. 1 shows in detail a diesel engine 10 of a motor vehicle with an exhaust gas aftertreatment system 12 and a control unit 14. The control unit 14 controls the diesel engine 10 and other things in a manner that the engine provides a torque, which is requested by a driver of the motor vehicle by operating a driver input sender 16. Additionally the control unit 14 controls the diesel engine 10 while taking into account the demands of the exhaust gas aftertreatment system 12. For these control tasks, signals from additional sensors, which depict the operating parameters of the diesel engine 10, are delivered to the control unit 14 in addition to the signal from the driver input sender 16. Essential operating parameters are in this connection particularly the rotational speed n of the diesel engine 10, which is provided by a rotational speed sensor 18, and an air mass mL, which enters the diesel engine 10 and which is acquired by an air mass gauge 20.

The control unit 14 calculates from the engine rotational speed n and the air mass mL among other things values for the fillings of the combustion chambers of the diesel engine 10 with air. Modern diesel engines have beyond these additional sensors, which acquire additional operating parameters like temperature, and/or concentrations of exhaust gas components, and/or combustion chamber pressures etc. The list of the sensors 16, 18 and 20 enumerated here is, therefore, not intended to be a final list.

The control unit 14 activates additionally actuating elements of the diesel engine 10, in order to operate the diesel engine 10 in a desired manner. The engine management system proceeds particularly in such a manner that the diesel engine 10 provides the torque desired by the driver. In so doing, the control unit 10 controls particularly the quantity of fuel injected by way of an injection valve configuration 22 into the combustion chambers of the diesel engine 10. Modern diesel engines have beyond the injection valve configuration 22 additional actuating elements like exhaust gas recirculation valves, turbo chargers with adjustable turbine geometry, throttle valves to choke the air supply, etc. While the injection valve configuration 22 can be assigned to a fuel management of the diesel engine 10, the other aforementioned actuating elements can be assigned to an air management of the diesel engine 10. Also in this case, it is true that the aforementioned actuating elements should not be understood as a final list.

The exhaust gas aftertreatment system 12 has at least one catalytic converter 24 and/or 26 with three-way conversion characteristics. In the embodiment in FIG. 1, the catalytic converter 24 is an oxidation catalytic converter, and the catalytic converter 26 is a $NO_x$ storage catalytic converter. Other embodiments of exhaust gas aftertreatment systems 12 have a SCR catalytic converter behind the oxidation catalytic converter 24 and/or a particle filter behind the oxidation catalytic converter 24. Additional embodiments of exhaust gas aftertreatment systems work with combinations of the three exhaust gas aftertreatment systems, for example with a tandem connection consisting of an oxidation catalytic converter, a storage catalytic converter and a particle filter or with a tandem connection consisting of a storage catalytic converter and a particle filter. It is essential in each case for at least one catalytic converter with three-way conversion characteristics to be present in the exhaust gas aftertreatment system 12.

The diesel engine 10 is operated in such a manner during a sufficiently powerful acceleration of the motor vehicle, which emerges during a corresponding torque request by the driver in the lower and middle engine rotational speed range, within the framework of the invention by means of interventions of the control unit 14 into the air management and/or the fuel management, so that the diesel engine 10 generates alternately an oxidizing and a reductive exhaust gas atmosphere before the oxidation catalytic converter 24 as an embodiment of a catalytic converter with three-way conversion characteristics.

The engine management of the diesel engine 10 by the control unit 14 occurs not only in such a way that the requested torque is provided, but additionally in such a way that a $NO_x$ conversion results effectively as possible through the interaction of the exhaust gases of the diesel engine 10 with their exhaust gas aftertreatment system 12.

Figure 2:
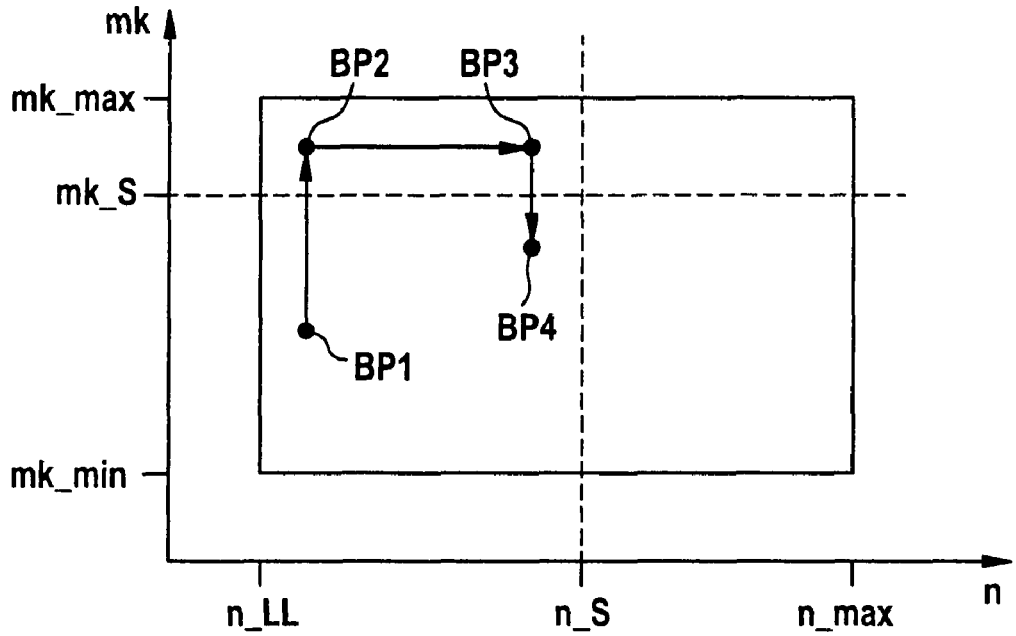
FIG. 2 an operating point range of the diesel engine constructed from fuel masses and engine rotational speed values.

In order to recognize the sufficiently powerful accelerations, which serve as a triggering criterion for an operation with an alternating oxidizing and reductive exhaust gas atmosphere, operating parameters and/or alterations in the operating parameters of the diesel engine 10 are evaluated in an embodiment. In an embodiment, values of a fuel mass mk injected per combustion chamber filling and of the rotational speed n of the diesel engine 10 are evaluated. FIG. 2 shows a plotting of possible mk, n-value pairs, which in the operation of the diesel engine can be approached, and thus define a range of possible operating points BP of the diesel engine. In the process, the spectrum of possible engine rotational speed values extends from a neutral idling rotational speed n_LL up to a maximum rotational speed n_max; and the spectrum of possible fuel masses extends from a value mk_min up to a value mk_max.

Additionally four operating points BP1, BP2, BP3 and BP4 are emphasized in FIG. 2. These four operating points are approached consecutively during a typical acceleration action. At the operating point BP1, the motor vehicle moves with comparatively low load and an engine rotational speed lying slightly over the neutral idling rotational speed n_LL in a steady state operating state of the diesel engine 10. Then the driver requests via the driver input sender 16 an elevated torque in order to accelerate the motor vehicle. In order to implement the elevated torque, the control unit 14 elevates the fuel mass mk to be injected, whereby the engine rotational speed n remains initially the same in a schematic depiction. After the setting of the elevated fuel mass, the diesel engine 10 is located at the operating point BP2. Here the engine generates a torque, which no longer fits into the relatively low engine rotational speed of the operating point BP1, so that the vehicle accelerates and the rotational speed n of the diesel engine 10*s* rises accordingly. If at the operating point BP3, the desired driving speed is achieved at an elevated rotational speed n of the diesel engine 10, the driver takes his torque request back and the control unit 14 adjusts to a smaller fuel mass mk, with which the motor vehicle continues to run at operating point BP4 in steady state at the elevated engine rotational speed.

The fuel mass mk represents thereby all parameters, which display a load of the diesel engine 10. Instead of the fuel mass mk, the parameter of the torque request can, for example, be used for the load. Additionally a measurement for the load can also be derived from signals of a combustion chamber sensor, a supercharging pressure sensor etc.

In a preferred embodiment, a sufficiently powerful acceleration is then recognized, if the rotational speed n of the diesel engine 10 increases without an engine rotational speed threshold value n_S being exceeded in the process, and its load thereby is greater than a load threshold value mk_S. This is the case in FIG. 2 during the transition from the operating point BP2 to the operating point BP3.

The diesel engine 10 according to the invention is operated in such a way during such a transition, which denotes a powerful acceleration, that the engine alternately generates an oxidizing and a reductive exhaust gas atmosphere before the catalytic converter 24.

Figure 3A:
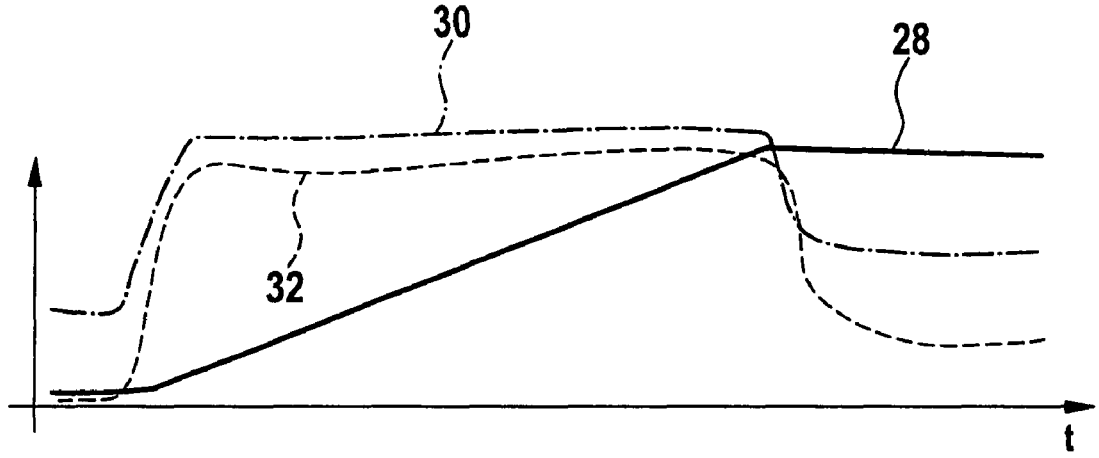
FIG. 3 chronological progressions of different operating parameters of the diesel engine during an acceleration action.

This is explained in detail below by reference to FIG. 3. In so doing, the FIG. 3*a* shows a chronological progression 28 of the engine rotational speed n during the transition between the operating points BP1 and BP4. The progression 30 corresponds to a corresponding torque progression, and the progression 32 corresponds to a corresponding progression of the $NO_x$ emissions before the catalytic converter of the diesel engine 10 during this transition. It can be readily recognized, how the torque increases from a low starting value at a low starting engine rotational speed to a high value, whereby the engine rotational speed simultaneously increases under the influence of the high torque before torque is reduced to an additional steady state value, at which a constant elevated engine rotational speed appears. During the acceleration with an increasing engine rotational speed occurring between the two states in steady state, the $NO_x$ emissions before the catalytic converter of the diesel engine 10 are elevated.

Figure 3B:
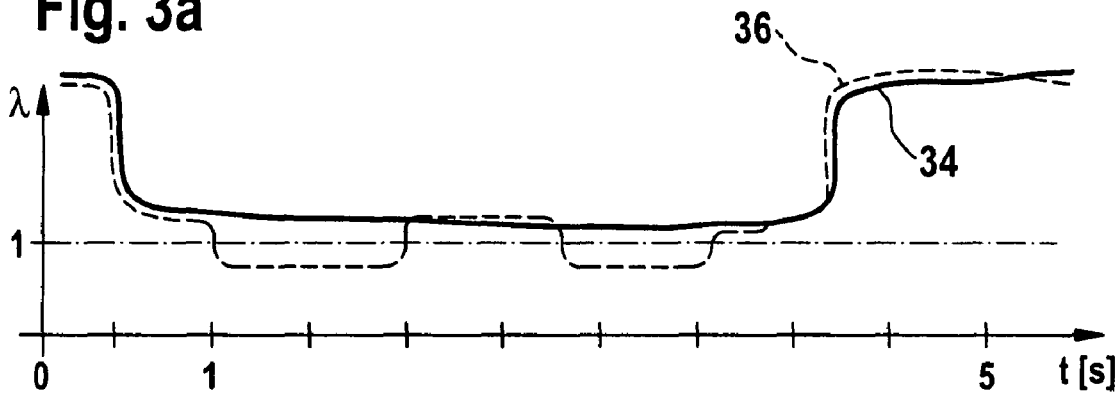

FIG. 3*b* shows a corresponding progression 34 of the air number λ (solid line), how it appears during a familiar procedure, and a progression 36 of the air number λ (dotted line), how it appears during the implementation of the procedure according to the invention. In the Figure, the air number λ indicates recognizably the ratio of two air quantities, whereby a first air quantity is available in the numerator for the combustion of a certain fuel mass, and the air mass located in the denominator corresponds to the air mass, which is required for a stoichiometric combustion of this fuel mass. λ-values greater than 1 correspond as a result to an air surplus and lead to an oxidizing exhaust gas atmosphere, whereas λ-values smaller than 1 correspond to a lack of air or a fuel surplus and lead, therefore, to a reductive exhaust gas atmosphere.

In the progression 34 the increase in the fuel mass mk by means of the reduction to λ-values in the neighborhood of 1 is depicted during the transition between the operating points BP1 and BP4, whereby the adjusted λ-values, however, run permanently above the λ=1 line. Accordingly an oxidizing exhaust gas atmosphere occurs constantly before the catalytic converter 24 during the progression 34. Within the exhaust gas atmosphere, the elevated $NO_x$ emissions of the progression 32 from the FIG. 3*a* do not experience a direct catalytic conversion.

In contrast a reductive exhaust gas atmosphere, which is alternately generated with an oxidizing exhaust gas atmosphere, also emerges in the progression 36, which periodically undershoots the λ=1 line. As a consequence, the inherently known three-way conversion effect occurs, during which the elevated $NO_x$ emissions of the progression 32 from the FIG. 3*a* experience a direct catalytic conversion during the powerful acceleration between the operating points BP1 and BP4.

Figure 4:
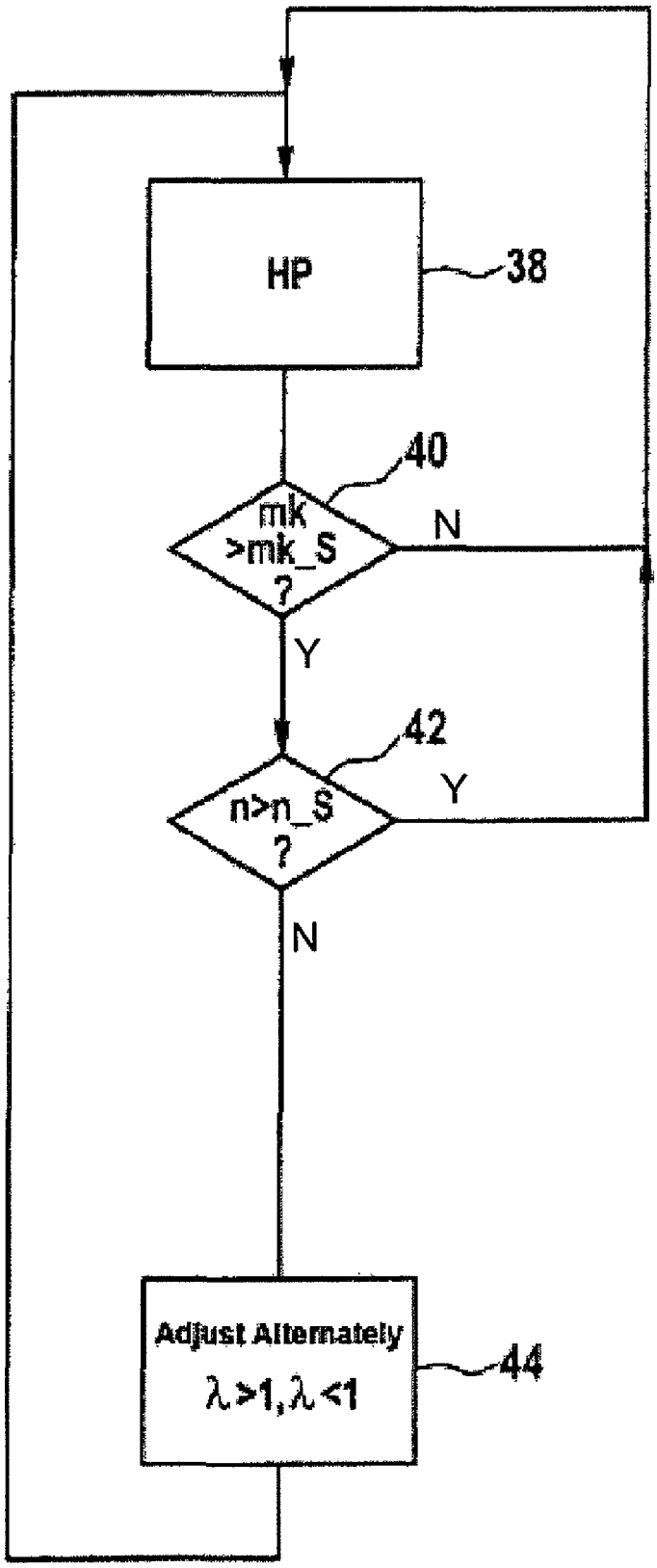
FIG. 4 a flow diagram as an example of embodiment of a procedure according to the invention.

FIG. 4 shows a flow diagram as an example of embodiment of a procedure according to the invention. The step 38 corresponds to an overriding main program HP for the engine management of the diesel engine 10 as it is processed in the control unit 14. A step 40, which emerges from the step 38, is accomplished, in that a check is made if a load parameter, for example the fuel mass mk, exceeds a threshold value, for example the threshold value mk_S. If this is not the case, the program reverts back to the main program of step 38. If on the other hand the request in step 40 is affirmed, a check is additionally made in step 42 to see if the engine rotational speed n is greater than a rotational speed threshold value n_S. If this request is affirmed, this indicates an operational point with a demanding load and a high engine rotational speed, which is not necessarily connected to a momentary acceleration, but, for example, also can be approached while driving at a constantly high speed. In this case, the program likewise reverts back to the main program of step 38.

If on the other hand the request in step 42 is negated, this indicates an operating state with a comparatively demanding load and a low engine rotational speed, which is typical for an individual acceleration. In this case, the program branches further into step 44, in which the control unit 14 sets alternately λ-values >1 and <1, so that the diesel engine 10 alternately generates an oxidizing and a reductive exhaust gas atmosphere before the catalytic converter 24.

The threshold value mk_S preferably draws a clear dividing line between the operating states lying in the vicinity of the full load and other operating states. The threshold value n_S preferably draws a dividing line between low and average engine rotational speeds and higher rotational speeds. The threshold value mk_S lies in one embodiment at approximately 80% of the full load value mk_max, and the engine rotational speed threshold value n_S lies in one embodiment at approximately 60% of the maximum rotational speed n_max.

The λ-value of the oxidizing exhaust gas atmosphere is preferably already reduced to a value of λ>1.2 before the generation of the reductive exhaust gas atmosphere in step 44.

It is also preferred that the λ-value is >0.8 during the generation of the reductive exhaust gas atmosphere and remain <1.2 during the generation of the oxidizing exhaust gas atmosphere. This produces comparatively small fluctuations of the λ-value during the transition between the reductive exhaust gas atmosphere and the oxidizing exhaust gas atmosphere and vice versa. As a consequence only fluctuations in torque and fluctuations in combustion noise arise, which are still tolerable.

Additionally the alternating generation of the reductive and oxidizing exhaust gas atmosphere in step 44 is controlled through interventions into the fuel system, respectively into the fuel management of the diesel engine 10. This can, for example, result by a change in the injected fuel quantities mk and/or the fuel injection paradigm. In so doing, it is especially preferable when the injected fuel quantities and the fuel injection paradigm are altered in such a manner, that effects of the change in injected fuel quantities on the torque of the diesel engine 10 are at least partially compensated for by the effects of the fuel injection paradigm on the torque. This can, for example, thereby be achieved, in that an increase in the injected fuel quantity to achieve a reductive exhaust gas atmosphere is combined with a retarding of the start of injection.

Figure 5:
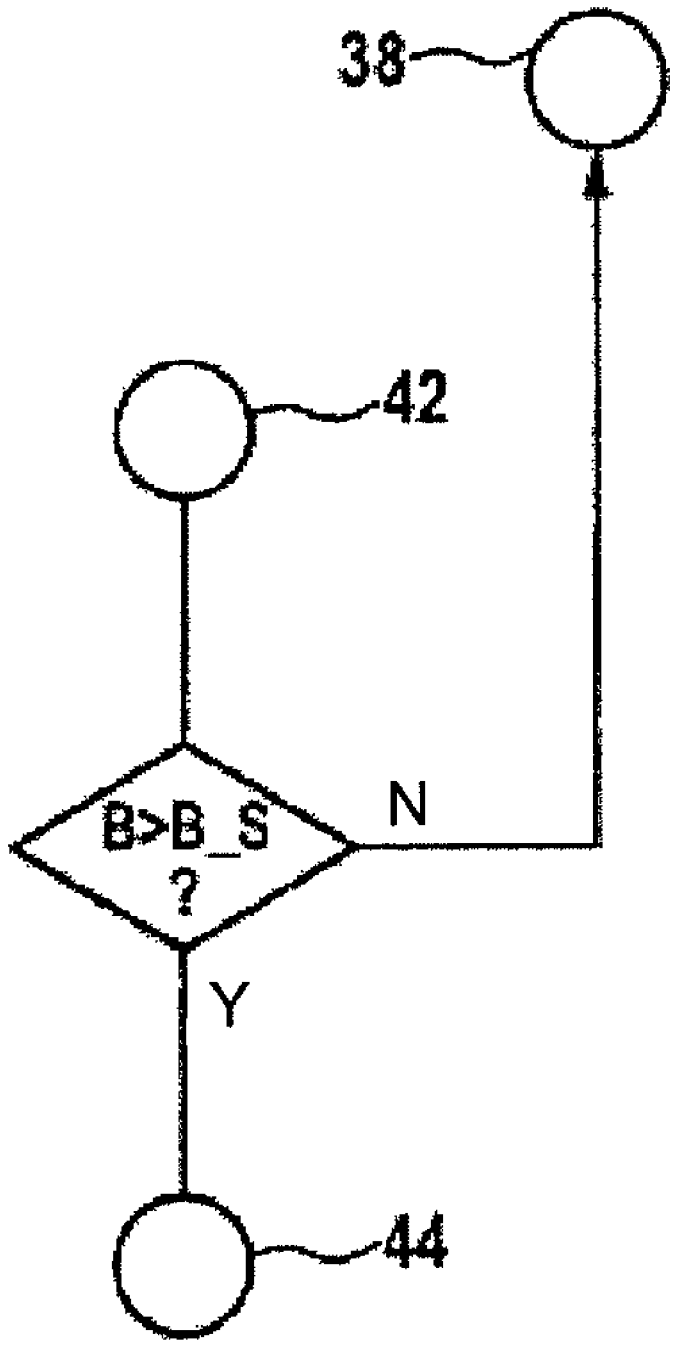
FIG. 5 a configuration of the flow diagram from FIG. 4.

FIG. 5 shows an additional embodiment, in which a change between the reductive and oxidizing exhaust gas atmospheres is only then set, if the control unit 14 initiates a regeneration of the storage catalytic converter 26. In so doing, a check is additionally made after the step 42 in a step 43, if a regeneration of the $NO_x$ storage catalytic converter has been initiated. This is then the case in an embodiment, if the storage catalytic converter 26 is loaded to a certain degree with nitrogen oxides. For this purpose, a measurement B for the depletion of the catalytic converter is established and is compared in step 43 with a threshold value B_S. If the threshold value B_S is not exceeded, the program reverts back to the main program of step 38 and the elevated $NO_x$ emissions before the catalytic converter of the diesel engine 10 are converted by way of the detour of a storage in the $NO_x$ catalytic converter 26. If the storage capability of the $NO_x$ storage catalytic converter 26 is in contrast already largely exhausted on account of too great a depletion, the request in step 43 will thus be affirmed. This affirmation enables a regeneration of the storage catalytic converter 26. Then step 44 follows.

The alternating generation of the reductive and oxidizing exhaust gas atmospheres leads then not only to a direct catalytic conversion of the elevated $NO_x$ emissions before the catalytic converter of the diesel engine 10; but it additionally effectuates the complete or partial regeneration of the $NO_x$ storage catalytic converter 26, when the time periods with the reductive exhaust gas atmosphere are of sufficient length. Provision is made in an additional embodiment to improve the regeneration, in that a ratio between reductive and oxidizing exhaust gas components is controlled during the alternating generation of the oxidizing and the reductive exhaust gas atmosphere as a function of the degree of depletion B from nitrogen of the $NO_x$ storage catalytic converter 26.

The control unit 14 thus characterizes itself, in that it is constructed and especially programmed for the purpose of controlling the diesel engine 10 according to one of the procedures described here.

The invention claimed is:

1. A method of operating a diesel engine that includes an exhaust gas aftertreatment system with a catalytic converter with three-way conversion characteristics, the method comprising:

if an engine rotational speed increases without exceeding an engine rotational speed threshold value and an engine load is greater than a load threshold value, operating the diesel engine such that the diesel engine alternately generates an oxidizing and a reductive exhaust gas atmosphere before the catalytic converter.

2. The method according to claim 1, further comprising limiting a lambda value of a fuel/air mixture to a value less than 1.2 by interventions into an air supply system of the diesel engine before the generation of a reductive exhaust gas atmosphere.

3. The method according to claim 1, further comprising if an overriding control of the diesel engine has enabled regeneration of a $NO_x$ storage catalytic converter, generating the reductive exhaust gas atmosphere during the operation of a diesel engine.

4. The method according to claim 1, further comprising controlling a ratio of reductive and oxidizing exhaust gas components during operation of a diesel engine, which has a $NO_x$ storage catalytic converter, during the alternating generation of the oxidizing and reductive exhaust gas atmosphere as a function of a degree of depletion from nitrogen oxides of the $NO_x$ storage catalytic converter.

5. The method according to claim 1, further comprising limiting the lambda value of a fuel/air mixture to a value greater than 0.8 during the generation of the reductive exhaust gas atmosphere and to a value smaller than 1.2 during the generation of the oxidizing exhaust gas atmosphere.

6. The method according to claim 5, further comprising controlling the alternating generation of the reductive exhaust gas atmosphere and the oxidizing exhaust gas atmosphere by interventions into a fuel system of the diesel engine.

7. The method according to claim 6, wherein controlling includes altering an injected fuel quantity or a fuel injection paradigm to achieve the interventions into the fuel system.

8. The method according to claim 7, wherein altering includes altering the injected fuel quantities and the fuel injection paradigm such that effects of the alteration of the injected fuel quantities on a torque of the diesel engine are at least partially compensated for by effects of the alterations of the fuel injection paradigm on the torque.

9. A control unit to operate a diesel engine that includes a catalytic converter with three-way conversion characteristics, wherein the control unit operates the diesel engine such that the diesel engine alternately generates an oxidizing and a reductive exhaust gas atmosphere before the catalytic converter if an engine rotational speed increases without in the process exceeding an engine rotational speed threshold value and an engine load exceeding a load threshold value.

* * * * *